US008022788B2

(12) United States Patent
Sarasa

(10) Patent No.: US 8,022,788 B2
(45) Date of Patent: Sep. 20, 2011

(54) FILTER WITH CROSSES

(75) Inventor: Pablo Sarasa, Voorhout (NL)

(73) Assignee: Thales (FR)

( * ) Notice: Subject to any disclaimer, the term of this patent is extended or adjusted under 35 U.S.C. 154(b) by 230 days.

(21) Appl. No.: 12/303,049

(22) PCT Filed: Jun. 1, 2007

(86) PCT No.: PCT/EP2007/055410

§ 371 (c)(1),
(2), (4) Date: Mar. 18, 2009

(87) PCT Pub. No.: WO2007/141213

PCT Pub. Date: Dec. 13, 2007

(65) Prior Publication Data

US 2009/0237184 A1 Sep. 24, 2009

(30) Foreign Application Priority Data

Jun. 2, 2006 (FR) ..... 06 52011

(51) Int. Cl.
*H01P 5/12* (2006.01)
*H01P 1/207* (2006.01)
*H01P 3/00* (2006.01)

(52) U.S. Cl. ..... 333/135; 333/137; 333/208; 333/239; 333/248

(58) Field of Classification Search ..... 333/135, 333/137, 208–212, 239, 248
See application file for complete search history.

(56) References Cited

U.S. PATENT DOCUMENTS 2,939,037 A 5/1960 Jepsen
4,862,186 A * 8/1989 Strider ..... 343/776
5,051,713 A 9/1991 Yokota

FOREIGN PATENT DOCUMENTS

DE 17 66 579 A1 8/1971
JP 63010802 A * 1/1988

OTHER PUBLICATIONS

Geng R L et al Institute of Electrical and Electronics Engineers: "Multipacting in a Rectangular Waveguide", Proceedings of the 2001 Particle Accelerator Conference. PAC 2001. Chicago, IL, Jun. 18-22, 2001, Particle Accelerator Conference, New York, NY: IEEE, US, vol. 1 of 5; (Jun. 18, 2001), p. 1228-1230, XP 010581205; ISBN: 0-7803-7191-7.

* cited by examiner

*Primary Examiner* — Robert Pascal
*Assistant Examiner* — Kimberly E Glenn
(74) *Attorney, Agent, or Firm* — Lowe Hauptman Ham & Berner, LLP

(57) ABSTRACT

The invention relates to a process for the production of a microwave waveguide having a step of determining the zone or zones of the waveguide where an electric field concentration occurs. A step of produces at least one enlargement of the waveguide in the zone or zones thus determined. The invention also relates to a microwave filter in which the stubs are provided with such enlargement. The invention has application in microwave filters.

19 Claims, 4 Drawing Sheets

FILTER WITH CROSSES

CROSS-REFERENCE TO RELATED APPLICATIONS

The present Application is based on International Application No. PCT/EP2007/055410, filed on Jun. 1, 2007, which in turn corresponds to French Application No. 06 52011 filed on Jun. 2, 2006, and priority is hereby claimed under 35 USC §119 based on these applications. Each of these applications are hereby incorporated by reference in their entirety into the present application.

FIELD OF THE INVENTION

The invention relates to a microwave waveguide, to its production process and to its application to a microwave filter, notably a very high-power microwave filter. The invention is applicable more particularly to filters comprising length-adjustable short-circuited transmission lines, called stubs in the art, and used for producing impedances. The invention also relates to a microwave transmit/receive station using the microwave filter applicable notably in the space field.

BACKGROUND OF THE INVENTION

In certain fields of application, there is a need for microwave filters of very high power. This is the case for example in the space field, where the transmit power must be particularly high and where the filters used must be effective at high power levels in order to provide a maximum transmit power. This is the case for example in direct transmission systems by satellite. The satellite must then be able to transmit with a maximum power. However, the invention is applicable in any other field in which high-power operation is required.

When a waveguide is used in a vacuum (for space applications) and in the case of high-power waveguides, it is possible to initiate an electron avalanche, called a multipactor effect, in certain zones of the waveguide.

This multipactor effect is caused by a concentration of the electromagnetic field which tears electrons out of the walls of the waveguide. The electrons are then accelerated toward the opposite wall of the waveguide. The impact of these electrons on the latter wall causes in turn electrons to be torn therefrom, and so on. An electron avalanche phenomenon thus occurs, which degrades the electrical performance of the waveguide and may lead to it being destroyed.

This phenomenon therefore occurs notably in the space field in which the waveguides operate in a vacuum in the absence of air molecules.

The multipactor power level is the maximum power at which a component can be used without initiating the multipactor effect. This threshold power can be calculated between two parallel plates from the following equation:

$$P=(1/\mathrm{VMF}^2)\times(V_{multi}^2/2Z_0)$$

where

- the multipactor threshold voltage ($V_{multi}$) is dependent on the type of equipment used to manufacture the waveguide, but this voltage is always proportional to the product of the frequency multiplied by the critical distance between the plates (f×d);
- the VMF (voltage magnification factor) is the ratio of the voltage at the point of calculation and the input voltage of the component. This VMF increases with the field concentration between the two plates at the calculation point; and
- the impedance ($Z_0$) depends on the standard of waveguide used and on the working frequency (normally fixed by the application).

To reduce this multipactor effect, it is possible either to move the walls of the waveguide further apart in order to increase the $V_{multi}$ or to reduce the electric field concentration in order to reduce the VMF.

Both these solutions pose problems. If moving the walls of the waveguide further apart is envisioned, the operating frequency range is reduced and the device will have difficulties matching the waveguide for all frequencies in the operating range.

To reduce the concentration of the electric field at the critical point, it is necessary to modify the topology of the devices, or even, in the case of filters, to change the type of filter.

The object of the invention is to solve these problems and to provide a microwave waveguide and microwave filters in which the multipactor power level has been notably increased.

SUMMARY OF THE INVENTION

The invention therefore relates to a process for the production of a microwave waveguide comprising the following steps:

- a step of determining the critical zone or zones of the waveguide where an electric field concentration occurs; and
- a step of producing at least one enlargement of the waveguide in the zone or zones thus determined.

This process is applicable to the production of a microwave filter comprising length-adjustable short-circuited transmission lines, such as stubs. This process includes:

- a step of determining, in the stubs, critical zones where electric field concentrations occur; and
- a step of producing at least one enlargement of the stubs in the zone or zones thus determined.

Advantageously, each enlargement is located at a distance $\lambda g/4$ from the short-circuit zone of the stub, $\lambda g$ being a guided wavelength lying within the operating wavelength range of the filter.

The invention also relates to a microwave filter produced by this process. Each stub takes the form of a Latin cross in which the horizontal arms perpendicular to the axis of the stub correspond to said enlargements.

According to one embodiment of the invention, the horizontal arms are of unequal lengths.

According to another embodiment of the invention, at least one horizontal arm has sections of different dimensions. The section closest to the axis of the stub is larger than the section or sections further away from the axis of the stub.

According to another embodiment, at least one horizontal arm has sections of different dimensions, the section closest to the axis of the stub being smaller than the section or sections further away from the axis of the stub.

It is also possible for the end face of each horizontal arm to be inclined to the axis of the stub.

According to another embodiment of the invention, it is also possible for the end face of each horizontal arm to have a curved shape.

The invention is also applicable to a microwave transmit/receive station using the microwave filter thus described. This station therefore comprises:

- a first diplexer for horizontally polarized signals and comprising a first receive filter and a first transmit filter as described above;

a second diplexer for vertically polarized signals and comprising a second receive filter and a second transmit filter as described above; and a polarization mode splitter/combiner having a first port for the horizontally polarized signals, connected to the first diplexer, a second port for the vertically polarized signals, connected to the second diplexer, and a third port connected to a transmit/receive horn.

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious aspects, all without departing from the invention. Accordingly, the drawings and description thereof are to be regarded as illustrative in nature, and not as restrictive.

BRIEF DESCRIPTION OF THE DRAWINGS

The present invention is illustrated by way of example, and not by limitation, in the figures of the accompanying drawings, wherein elements having the same reference numeral designations represent like elements throughout and wherein.

DETAILED DESCRIPTION

Figure 1A:
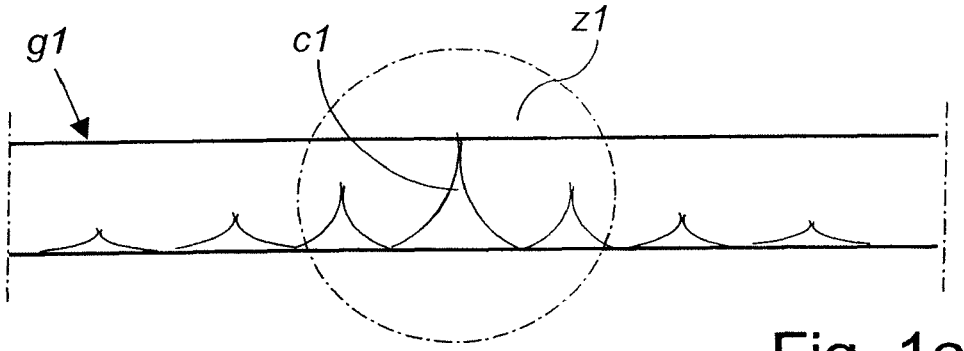
FIG. 1*a*, a representation of a waveguide for explaining the subject of the invention.

FIG. 1*a* shows a waveguide g1 for propagating a microwave. As is known, variations in electromagnetic energy levels can be detected in the waveguide. Variations in energy levels are illustrated in FIG. 1*a*. Energy concentrations appear: notably, in the zone z1 of the waveguide, a maximum c1 may be the cause of a multipactor effect, as described above. The zone z1 of the waveguide may then be damaged.

To remedy this, the invention therefore provides a way of identifying and locating the zones, such as Z1, in which there may be energy concentrations, and of enlarging the waveguide in these zones.

Figure 1B:
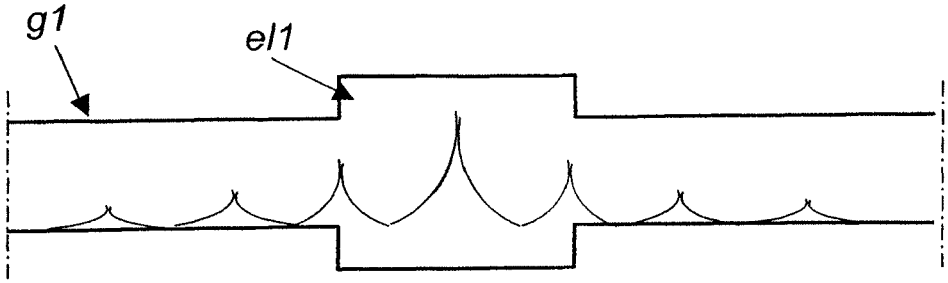
FIG. 1*b*, an exemplary embodiment of a waveguide according to the invention.

FIG. 1*b* therefore shows an example of a waveguide according to the invention in which the walls of the waveguide g1 have an enlargement el1. This enlargement is produced in such a way that the energy concentration in the zone z1 cannot give rise to a multipacter effect.

The invention is also applicable to the production of microwave filters.

Figure 2:
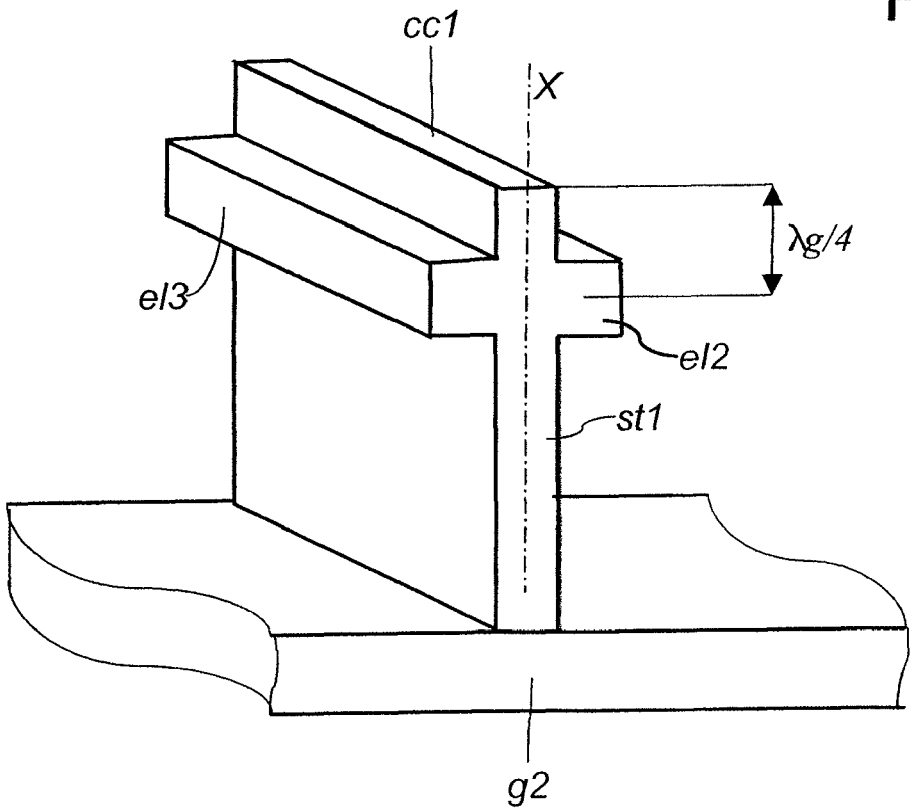
FIG. 2, an exemplary embodiment of a filter according to the invention.

FIG. 2 shows a portion of a filter that includes coupled impedance-matching elements as shunts on the main waveguide and terminating in short circuits. Such elements are called stubs in the art and will therefore be referred to by this term in the rest of the description.

It has been found that the stubs of the filters are the site of electromagnetic energy concentrations. To avoid the creation of multipacter effects in the stubs, an enlargement is therefore provided in the energy concentration zones.

In a stub, such as st1 in FIG. 2, the maximum energy concentration, for a given wavelength λg, occurs at a distance λg/4 from the short-circuit face cc1 of the stub. The invention therefore provides, at this distance cc1, enlargements el2 and el3 on the two guiding walls of the stub. The stub therefore takes the form of a Latin cross, the horizontal arms of which are perpendicular to the axis X of the stub sd1 and form the enlargements el2 and el3.

An example of the invention applied to a microwave filter having stubs will now be described with reference to FIGS. 3, 4*a* and 4*b*.

Figure 3:
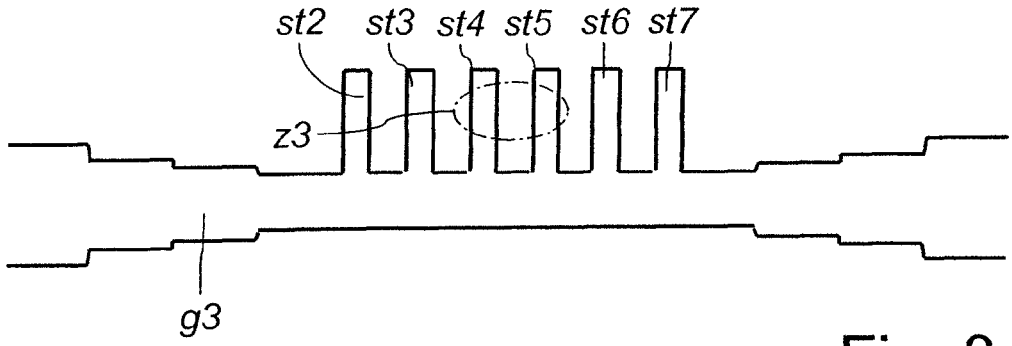
FIG. 3, a microwave filter comprising stubs with a low multipactor power level which carries the risk of initiating the multipactor effect.
Figure 4A:
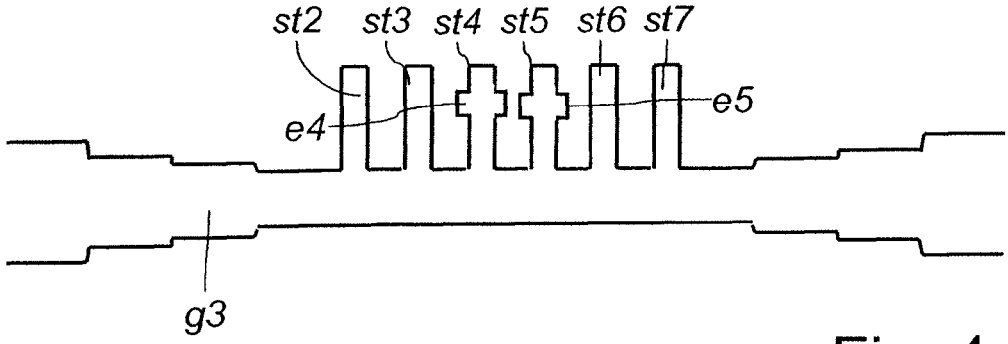
FIGS. 4*a* and 4*b*, exemplary embodiments of a microwave filter having stubs according to the invention.
Figure 4B:
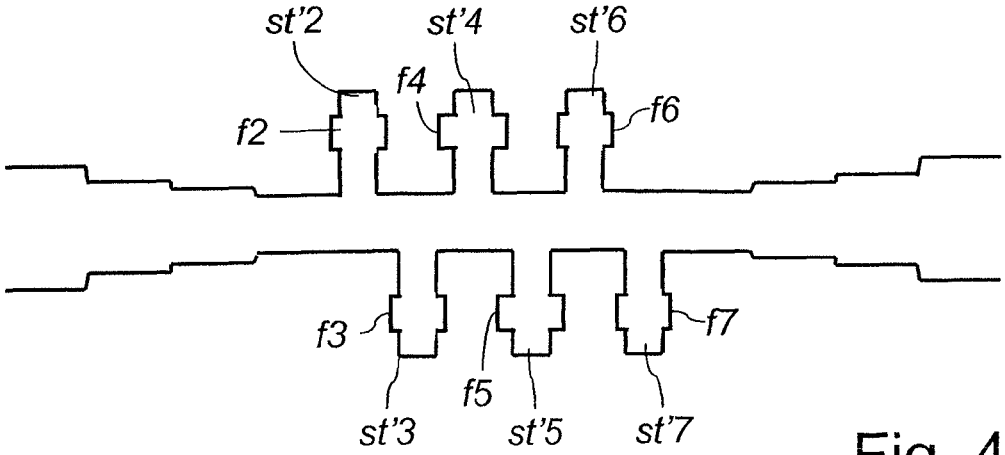

FIG. 3 shows a filter g3 of known type, having six stubs st2 to st7. An energy maximum liable to create a multipactor effect is found in the zone z3 in the stubs st4 and st5.

The invention makes it possible to avoid this multipactor effect. To do this, as shown in FIG. 4*a*, the stubs st4 and st5 have enlargements e4 and e5 in the zone z3. These enlargements were positioned as described above.

However, in certain cases the distance between stubs may not allow these enlargements to be provided in a filter of the type shown in FIG. 3. The stubs may then be distributed on either side of the main axis of the filter. What is therefore obtained is a configuration as shown in FIG. 4*b*. In addition, this configuration provides enlargements f2 to f7 on all the stubs st'2 to st'7. Since the maximum energy concentration is highest in the stubs st'4 and st'5, the enlargements f4 and f5 of these stubs will be larger than the enlargements f3 and f6 of the stubs st'3 and st'6 and much larger than the enlargements f2 and f7 of the stubs st'2 and st'7.

The enlargements may take different forms.

FIGS. 5*b* to 7*c* give various examples of these forms.

Figure 5A:
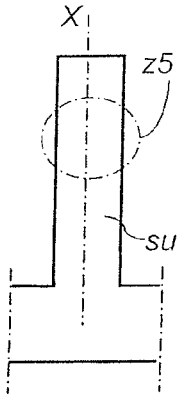
FIGS. 5*a* to 5*e*, various embodiments of the stubs of a microwave filter.

The aim is to avoid creating a multipactor effect in a stub su1 shown in FIG. 5*a* and in which, without enlargement according to the invention, a multipactor effect would be created.

Figure 5B:
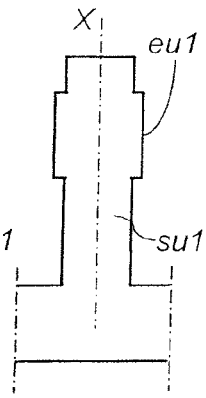
Figure 5C:
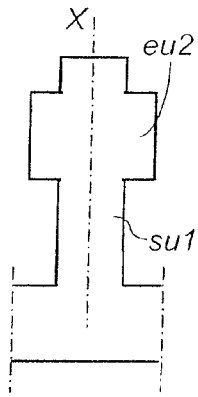

FIGS. 5*b* and 5*c* show stubs su1 having enlargements eu1 and eu2 as described above. The enlargement eu2 is larger than the enlargement eu1 and is provided for a higher initial energy concentration in the stub of FIG. 5*c* than in the stub of FIG. 5*b*.

Figure 5D:
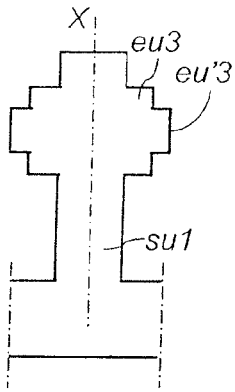

The stub of FIG. 5*d* possesses enlargements having different sections. A first enlargement eu3 is of relatively large size, and this enlargement has a second enlargement eu'3 of smaller size.

Figure 5E:
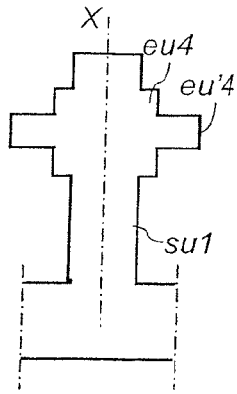

The enlargements eu4 and eu'4 of FIG. 5*e* are of the same type as those of FIG. 5*d*, but are of smaller dimensions so as to be effective at different energy levels.

In these stubs, the enlargements are symmetrical with respect to the axis X of the stubs.

Figure 6A:
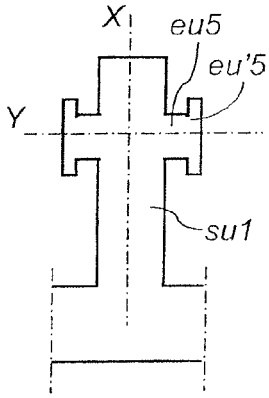
FIGS. 6*a* to 6*c* and 7*a* to 7*c*, alternative embodiments of stubs according to the invention.

FIG. 6*a* shows a stub having an enlargement eu5, which itself has an enlargement eu'5 of larger size. The enlargements are symmetrical with respect to the axis X of the stub and the enlargement eu'5 is symmetrical with respect to the axis Y of the enlargement eu5.

Figure 6B:
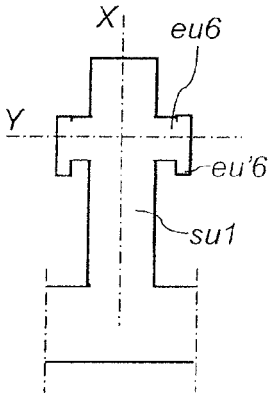

FIG. 6*b* shows a stub of the same type as that in FIG. 6*a*, but in which the enlargement eu'6 is not symmetrical with respect to the axis Y of the enlargement eu6.

Figure 6C:
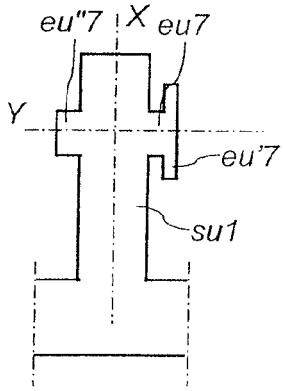

FIG. 6*c* shows a stub that has an enlargement e"7 on one side of the axis X of the stub and it has, on the other side of the axis X, an enlargement eu7 which itself has an enlargement eu'7 of larger size.

Provision is therefore made for producing enlargements that are not symmetrical with respect to the axes X of the stubs.

Figure 7A:
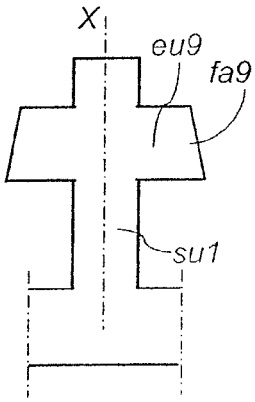

Moreover, provision may be made for the faces of the ends of the enlargements furthest away from the axis X of the stub not to be parallel to the axis X. This is shown in FIGS. 7*a* and 7*b* by the faces fa9 and fa10, which are inclined to the axis X.

Figure 7B:
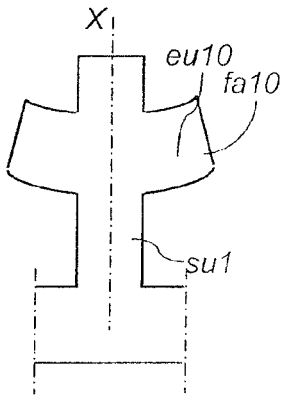

There may also be provision for the walls of the enlargements to have curved surfaces, as shown in FIG. 7*b*.

Figure 7C:
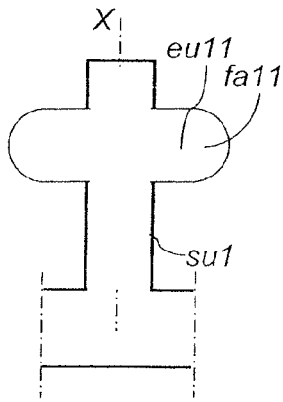

According to another embodiment shown in FIG. 7*c*, the end faces fall of the enlargements eu11 may be of curved shape.

The various enlargement shapes described above, preventing the multipactor effect, were described within the context of an application to stubs of a filter, but they could be applied to any microwave waveguide.

By providing stubs as described in the invention, the power level of the filter may be very greatly increased.

Moreover, the stubs as described in the invention have a volume larger than a stub without an enlargement, as shown in FIG. 5*a*. This increase in volume results in a significant reduction in ohmic losses. It is therefore possible to use this invention to reduce the ohmic losses of a waveguide and more especially in a filter.

An example of such a filter applied in a transmit/receive unit on board a satellite will now be described with reference to FIG. 8.

Such a unit must be able to transmit and receive signals at different energy levels. It must transmit at a maximum energy level and it must receive relatively attenuated signals.

Figure 8:
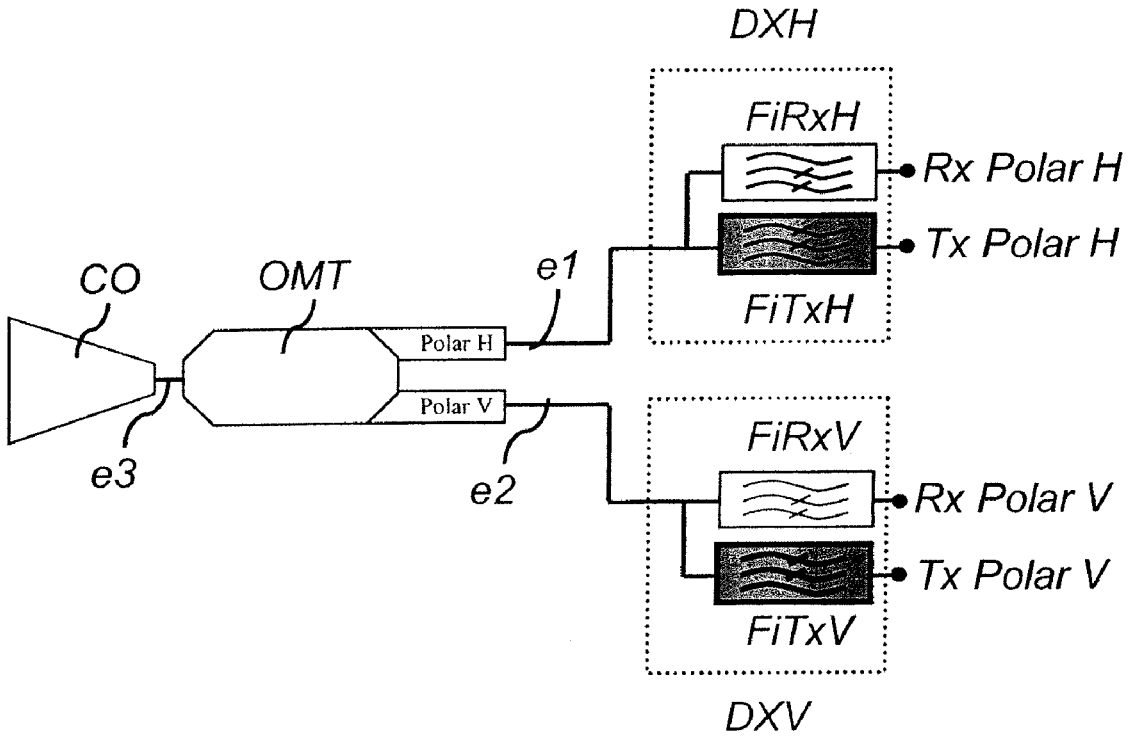
FIG. 8, an example of the invention applied to a microwave transmitter/receiver.

The unit shown in FIG. 8 has a single, common horn CO for both transmitting and receiving.

Diplexer filters DXH and DXV, for horizontal polarization and vertical polarization respectively, are connected to the ports e1 and e2 of a polarization mode splitter/combiner OMT, which is connected via its port e3 to the transmit/receive horn CO.

The receive filters FiRxH and FiRxV may be of relatively low operating power. In contrast, the transmit filters FiTxH and FiTxV must be able to operate at high power levels.

The transmit filters FiTxH and FiTxV are designed according to the invention to allow high power levels. It is then possible to produce a unit as shown in FIG. 8 with a single horn CO, for both transmitting and receiving.

The invention therefore makes it possible to obtain, in a waveguide and more particularly in a filter:

- a large increase in the power capability, avoiding the multipactor effects;
- a reduction in ohmic losses;
- a structure completely compatible with the methods currently used to manufacture filters with "stubs" that guarantee low passive intermodulation products (PIMPs)l; and
- a potential saving of one antenna on a satellite. It is possible to combine the transmit (Tx) and receive (Rx) functions into a single antenna even if the Tx power levels are high.

It will be readily seen by one of ordinary skill in the art that the present invention fulfils all of the objects set forth above. After reading the foregoing specification, one of ordinary skill in the art will be able to affect various changes, substitutions of equivalents and various aspects of the invention as broadly disclosed herein. It is therefore intended that the protection granted hereon be limited only by definition contained in the appended claims and equivalents thereof.

The invention claimed is:

1. A process for production of a microwave filter comprising stubs, and including production of a microwave waveguide, comprising:

- a step of determining a critical zone or zones of a waveguide where an electric field concentration occurs; and
- a step of producing at least one enlargement of the waveguide in the critical zone or zones thus determined,
- a step of determining, in the stubs, the critical zone or zones where electric field concentrations occur; and
- a step of producing at least one enlargement of the stubs in the critical zone or zones thus determined;
- wherein each of the stubs takes the form of a Latin cross in which horizontal arms perpendicular to an axis of each of the stubs correspond to said at least one enlargement of the stubs.

2. The process as claimed in claim 1, wherein each of the at least one enlargement of the stubs is located at a distance $\lambda g/4$ from a short-circuit zone of the corresponding at least one enlargement of the stubs, $\lambda g$ being a guided wavelength lying within an operating wavelength range of the microwave filter.

3. The process as claimed in claim 2, wherein at least one horizontal arm has sections of different dimensions, the section closest to the axis of the the corresponding stub being larger than the section or sections further away from the axis of the corresponding stub.

4. The process as claimed in claim 2, wherein at least one horizontal arm has sections of different dimensions, the section closest to the axis of the corresponding stub being smaller than the section or sections further away from the axis of the corresponding stub.

5. The process as claimed in claim 1, wherein the horizontal arms are of unequal lengths.

6. The process as claimed in claim 5, wherein at least one horizontal arm has sections of different dimensions, the section closest to the axis of the corresponding stub being larger than the section or sections further away from the axis of the corresponding stub.

7. The process as claimed in claim 5, wherein at least one horizontal arm has sections of different dimensions, the section closest to the axis of the corresponding stub being smaller than the section or sections further away from the axis of the corresponding stub.

8. The process as claimed in claim 1, wherein at least one of the horizontal arms has sections of different dimensions, the section closest to the axis of the corresponding stub being larger than the section or sections further away from the axis of the corresponding stub.

9. The process as claimed in claim 8, wherein at least one horizontal arm has sections of different dimensions, the section closest to the axis of the corresponding stub being smaller than the section or sections further away from the axis of the corresponding stub.

10. The process as claimed in claim 1, wherein at least one of the horizontal arms has sections of different dimensions, the section closest to the axis of the corresponding stub being smaller than the section or sections further away from the axis of the corresponding stub.

11. The process as claimed in claim 1, wherein an end face of each of the horizontal arms is inclined to the axis of the corresponding stub.

12. The process as claimed in claim 1, wherein an end face of each of the horizontal arms has a curved shape.

13. A microwave transmit/receive station comprising the microwave filter produced using the process as claimed in claim 1, comprising:

a first diplexer for horizontally polarized signals and comprising a first receive filter and a first transmit filter;

a second diplexer for vertically polarized signals and comprising a second receive filter and a second transmit filter; and a polarization mode splitter/combiner having a first port for the horizontally polarized signals, connected to the first diplexer, a second port for the vertically polarized signals, connected to the second diplexer, and a third port connected to a transmit/receive horn.

14. The microwave transmit/receive station as claimed in claim 13, wherein each one of the at least one enlargement of the stubs is located at a distance $\lambda g/4$ from a short-circuit zone of the corresponding one of the at least one enlargement of the stubs, $\lambda g$ being a guided wavelength lying within an operating wavelength range of the filter.

15. The microwave transmit/receive station as claimed in claim 13, wherein the horizontal arms are of unequal lengths.

16. The microwave transmit/receive station as claimed in claim 13, wherein at least one horizontal arm has sections of different dimensions, the section closest to the axis of the corresponding stub being larger than the section or sections further away from the axis of the corresponding stub.

17. The microwave transmit/receive station as claimed in claim 13, wherein at least one horizontal arm has sections of different dimensions, the section closest to the axis of the corresponding stub being smaller than the section or sections further away from the axis of the corresponding stub.

18. The microwave transmit/receive station as claimed in claim 13, wherein an end face of each of the horizontal arms is inclined to the axis of the stub.

19. The microwave transmit/receive station as claimed in claim 13, wherein an end face of each of the horizontal arms has a curved shape.

* * * * *